US010024157B2

(12) United States Patent
Fairhurst

(10) Patent No.: US 10,024,157 B2
(45) Date of Patent: Jul. 17, 2018

(54) SPRAY NOZZLE FOR UNDERGROUND ROOF SUPPORT

(71) Applicant: Joy MM Delaware, Inc., Wilmington, DE (US)

(72) Inventor: Andrew G. Fairhurst, Abingdon, VA (US)

(73) Assignee: Joy Global Underground Mining LLC, Warrendale, PA (US)

( * ) Notice: Subject to any disclaimer, the term of this patent is extended or adjusted under 35 U.S.C. 154(b) by 0 days.

(21) Appl. No.: 15/368,116

(22) Filed: Dec. 2, 2016

(65) Prior Publication Data

US 2017/0159436 A1 Jun. 8, 2017

Related U.S. Application Data

(60) Provisional application No. 62/263,251, filed on Dec. 4, 2015.

(51) Int. Cl.

| | |
|---|---|
| ***E21D 23/00*** | (2006.01) |
| ***E21F 5/02*** | (2006.01) |
| ***B05B 1/26*** | (2006.01) |
| ***E21D 23/06*** | (2006.01) |

(52) U.S. Cl.
CPC ..... *E21F 5/02* (2013.01); *B05B 1/26* (2013.01); *E21D 23/06* (2013.01)

(58) Field of Classification Search
CPC .... E21F 5/02; E21F 5/04; E21C 35/22; E21D 23/0004
USPC ..... 405/293, 295, 299; 299/81.3
See application file for complete search history.

(56) References Cited

U.S. PATENT DOCUMENTS

| | | | | |
|---|---|---|---|---|
| 3,756,558 | A | 9/1973 | Okui | |
| 3,859,801 | A | 1/1975 | Weirich | |
| 4,219,239 | A | 8/1980 | Weikert et al. | |
| 4,243,268 | A | 1/1981 | Lobbe et al. | |
| 4,552,487 | A | 11/1985 | Weirich | |
| 5,007,684 | A * | 4/1991 | Parrott | E21C 35/187 175/424 |

(Continued)

FOREIGN PATENT DOCUMENTS

| | | |
|---|---|---|
| EP | 0523328 A2 | 1/1993 |
| EP | 0850694 B1 | 3/2003 |

OTHER PUBLICATIONS

European Extended Search Report for Application 16002586.2 dated Aug. 21, 2017 (9 pages).

*Primary Examiner* — Sean D Andrish
(74) *Attorney, Agent, or Firm* — Michael Best & Friedrich LLP

(57) ABSTRACT

A fluid spray for an underground roof support includes a first housing portion, a spray outlet, a second housing portion formed integrally with the first housing portion, and a service port. The first housing portion includes an elongated shaft having a first end, a second end, and a first fluid passage extending between the first end and the second end. The spray outlet is positioned adjacent the second end of the shaft. The second housing portion is positioned adjacent the first end of the shaft. The second housing portion includes at least one port and a second fluid passage between the at least one port and the first fluid passage. The service port is aligned with the first fluid passage, and the service port is selectively opened to provide access to the first fluid passage from the first end of the first housing portion.

21 Claims, 11 Drawing Sheets

(56) References Cited

U.S. PATENT DOCUMENTS

| | | | | |
|---|---|---|---|---|
| 5,611,646 | A | 3/1997 | Voss | |
| 6,247,759 | B1 * | 6/2001 | Montgomery, Jr. .. | E21C 35/187 175/424 |
| 7,682,107 | B2 * | 3/2010 | Crayne ..... | E21F 15/10 405/263 |
| 2007/0158995 | A1 * | 7/2007 | Suilmann ..... | E21C 35/22 299/81.1 |
| 2007/0228804 | A1 | 10/2007 | Crayne et al. | |
| 2011/0006587 | A1 * | 1/2011 | Parrott ..... | E21C 35/187 299/81.3 |

* cited by examiner

SPRAY NOZZLE FOR UNDERGROUND ROOF SUPPORT

REFERENCE TO RELATED APPLICATION

This application claims the benefit of prior-filed, U.S. Provisional Patent Application No. 62/263,251, filed Dec. 4, 2015, the entire contents of which are hereby incorporated by reference.

BACKGROUND

The present disclosure relates to dust suppression systems, and particularly to a spray nozzle for a roof support in an underground mine environment.

Longwall mining systems typically include a plough or shearer for excavating or cutting material from a mine face. The cut material is deposited on a face conveyor, which carries the material away from the mine face for further processing. Multiple powered roof supports may be positioned adjacent the mine face to protect mine operators and equipment against falling material. As the mining operation progresses, each roof support is advanced to support a portion of the mine roof over the mining machine and conveyor.

SUMMARY

In one aspect, a fluid spray for an underground roof support includes a first housing portion, a spray outlet, a second housing portion formed integrally with the first housing portion, and a service port. The first housing portion includes an elongated shaft having a first end, a second end, and a first fluid passage extending between the first end and the second end. The spray outlet is positioned adjacent the second end of the shaft. The second housing portion is positioned adjacent the first end of the shaft. The second housing portion includes at least one port and a second fluid passage providing fluid communication between the at least one port and the first fluid passage. Each port is configured to be coupled to a fluid conduit. The service port is aligned with the first fluid passage, and the service port is selectively opened to provide access to the first fluid passage from the first end of the first housing portion.

In another aspect, a canopy for an underground mine roof support includes a first surface, a second surface spaced apart from and facing away from the first surface, at least one lug, and at least one fluid spray nozzle. The first surface is configured to be biased against a mine roof. The first surface includes a first end, a second end, and at least one opening positioned between the first end and the second end. Each lug is positioned adjacent an associated opening. Each lug includes a threaded bore in communication with the associated opening. Each fluid spray nozzle includes a shaft having a first end and a second end. A portion of the shaft proximate the second end threadably engages the threaded bore of an associated one of the at least one lugs such that the second end of the shaft is positioned adjacent the associated opening. Each fluid spray nozzle further includes a spray outlet positioned on the second end.

In yet another aspect, a roof support for an underground mine includes a base configured to be coupled to a face conveyor, a jack coupled to the base, and a canopy coupled to the jack. The jack is extendable and retractable relative to the base. The canopy includes a first surface, a second surface, at least one lug, and at least one fluid spray nozzle. The first surface is configured to be biased against a roof surface. The first surface includes a first end, a second end, and at least one opening positioned between the first end and the second end. The second surface is spaced apart from and faces away from the first surface. Each lug is positioned adjacent an associated one of the at least one openings. Each lug includes a threaded bore in communication with the associated opening. Each fluid spray nozzle includes a shaft having a first end and a second end. A portion of the shaft proximate the second end threadably engages the threaded bore of an associated one of the at least one lugs such that the second end of the shaft is positioned adjacent the associated opening. Each fluid spray nozzle further includes a spray outlet positioned on the second end.

Other aspects will become apparent by consideration of the detailed description and accompanying drawings.

Before any embodiments are explained in detail, it is to be understood that the disclosure is not limited in its application to the details of construction and the arrangement of components set forth in the following description or illustrated in the following drawings. The disclosure is capable of other embodiments and of being practiced or of being carried out in various ways. Also, it is to be understood that the phraseology and terminology used herein is for the purpose of description and should not be regarded as limiting. Use of "including" and "comprising" and variations thereof as used herein is meant to encompass the items listed thereafter and equivalents thereof as well as additional items. Use of "consisting of" and variations thereof as used herein is meant to encompass only the items listed thereafter and equivalents thereof. Unless specified or limited otherwise, the terms "mounted," "connected," "supported," and "coupled" and variations thereof are used broadly and encompass both direct and indirect mountings, connections, supports, and couplings.

DETAILED DESCRIPTION

Figure 1:
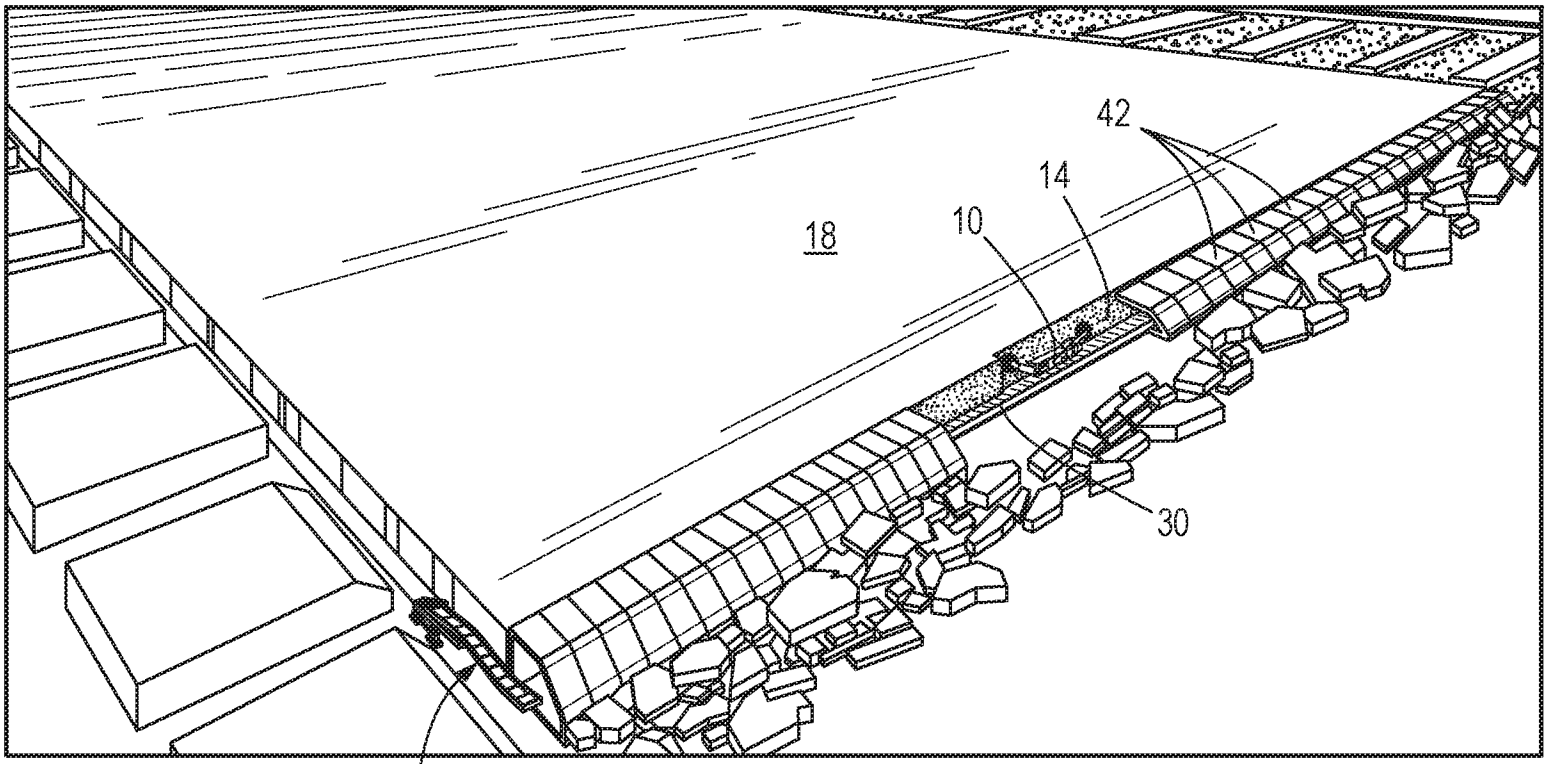
FIG. 1 is a perspective view of a mining operation.
Figure 2:
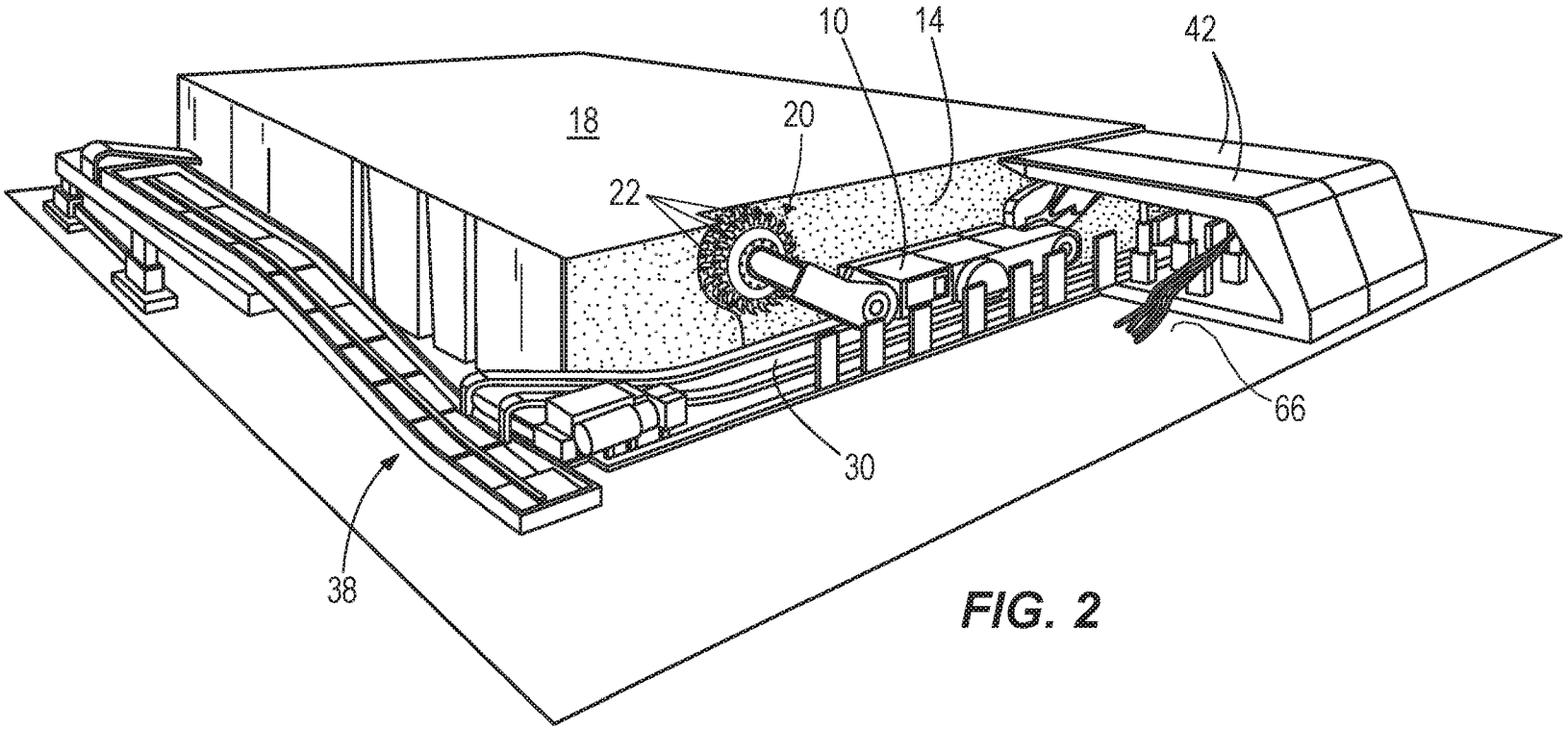
FIG. 2 is an enlarged perspective view of the mining operation of FIG. 1.

FIGS. 1 and 2 illustrate a longwall mining operation. A mining machine 10 excavates material from a mine face 14 of a mineral seam 18, and progresses through the seam 18 as material is removed. In the illustrated embodiment, the mining operation is "retreating" such that the shearer 10 progresses through the seam 18 toward a mine exit (not shown). In other embodiments, the operation may be "advancing" such that the shearer 10 progresses through the seam 18 away from the mine exit.

In the illustrated embodiment, the mining machine 10 is a conventional longwall shearer that moves or trams along the mine face 14. As shown in FIG. 2, the mining machine 10 includes rotating cutting drums 20 including cutting bits 22 that engage the mine face 14 and cut material from the mine face 14. Each drum 20 may include vanes 26 (FIG. 4A) for carrying the cut material from the face 14 toward a rear end of the drum 20, where the material is deposited onto a face conveyor 30. The face conveyor 30 moves the material toward an edge of the mine face 14, where the cut material may be transferred to a main gate conveyor via a beam stage loader 38 (FIG. 2). In some embodiments, the face conveyor 30 is a chain conveyor including flight bars coupled between multiple chain strands. Other aspects of the structure and operation of the machine 10 and the conveyor 30 will be readily understood by a person of ordinary skill in the art.

As shown in FIGS. 1 and 2, powered roof supports 42 are aligned in a row along the length of the mine face 14 to provide protection to operators as well as the components of the mining operation (e.g., the mining machine 10, the face conveyor 30). For illustration purposes, some of the roof supports 42 are removed in FIGS. 1 and 2.

Figure 3:
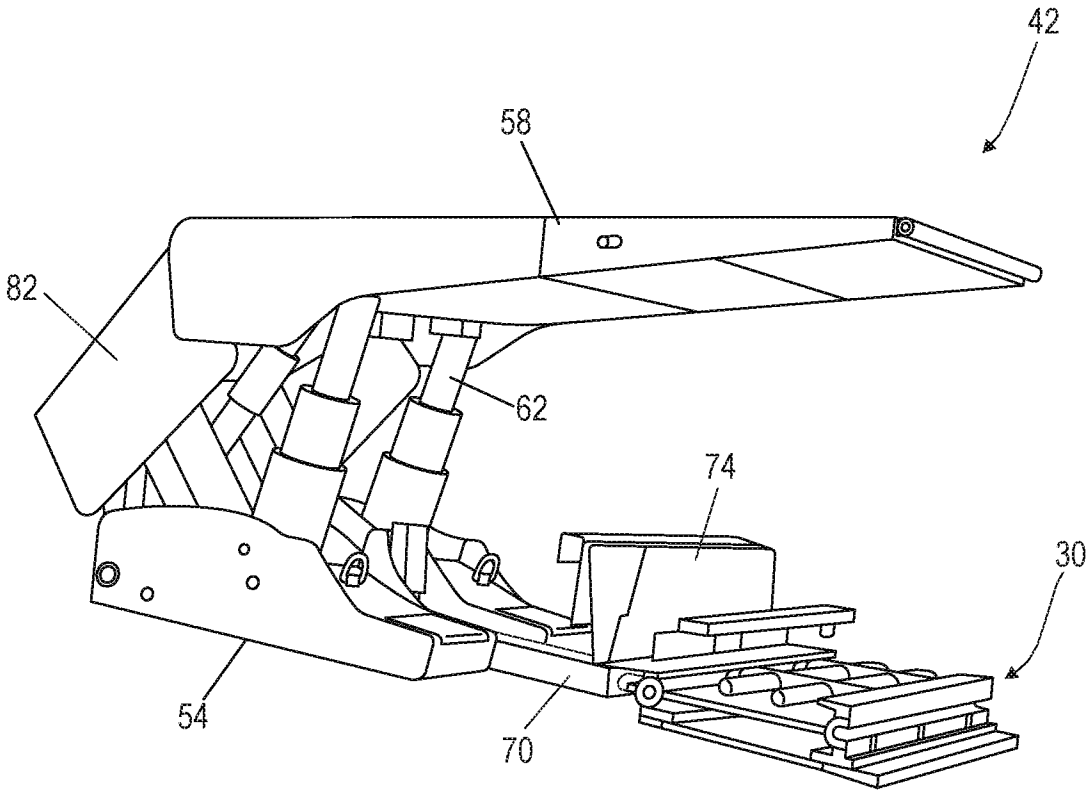
FIG. 3 is a perspective view of a roof support and a portion of a face conveyor.

Referring now to FIG. 3, each roof support 42 includes a base 54, a canopy 58, and actuators or jacks 62 extending between the base 54 and the canopy 58. The base 54 is positioned on the support surface or floor 66 (FIG. 2) and is coupled to the face conveyor 30 by a linear actuator 70 (e.g., a hydraulic cylinder or ram). In the illustrated embodiment, a spill plate 74 is positioned between the conveyor 30 and the roof support 42. The canopy 58 is positioned adjacent a hanging wall or mine roof 78 (FIG. 4A), and the jacks 62 bias the canopy 58 against the mine roof 78. In the illustrated embodiment, each roof support 42 also includes a shield 82 positioned between a rear end of the base 54 and a rear end of the canopy 58.

Figure 4A:
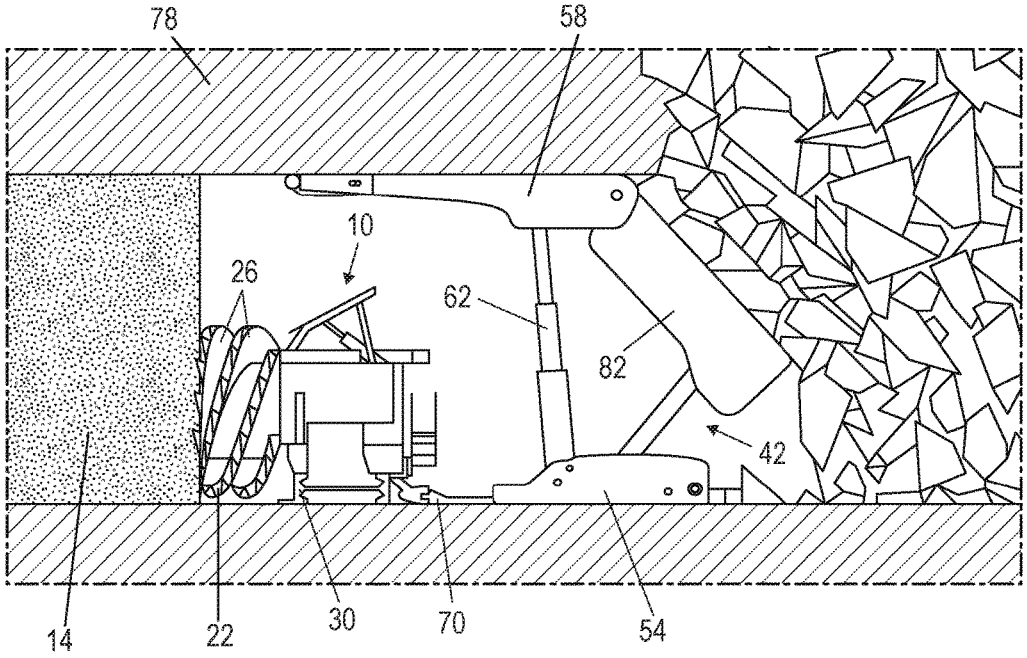
FIG. 4A is a side view of a mining machine, a face conveyor, and a roof support, with the roof support in a first position.
Figure 4B:
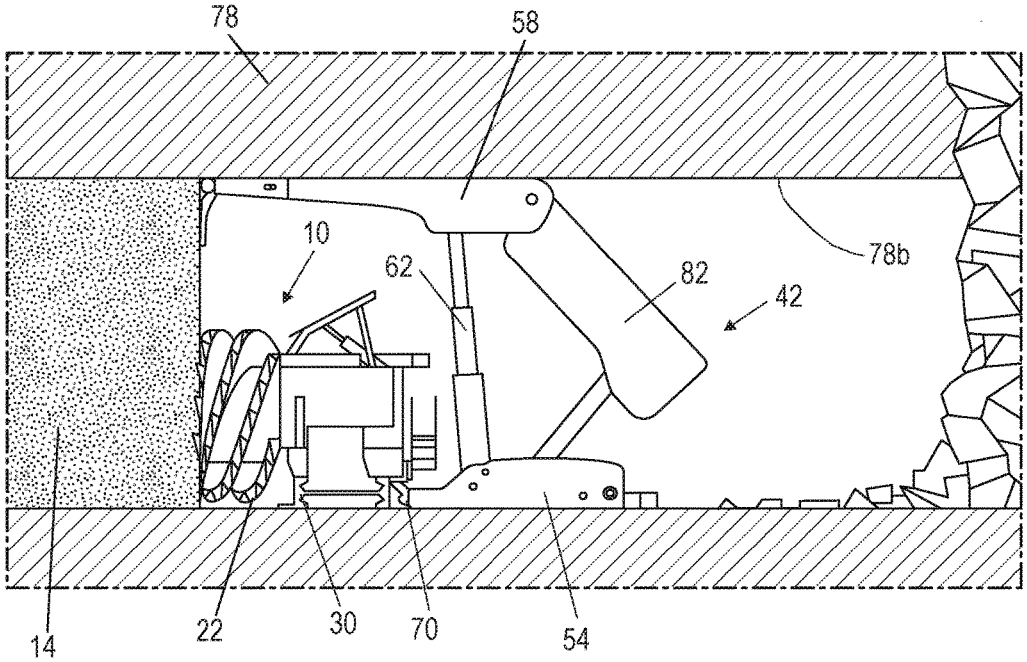
FIG. 4B is a side view of the mining machine, the face conveyor and the roof support of FIG. 4A, with the roof support in a second portion.

FIGS. 4A and 4B illustrate the advance of one of the roof supports 42 during the mining operation. After the mining machine 10 completes a cutting pass on the mine face 14, the machine 10 is advanced into the face 14 (FIG. 4A). Subsequently, each roof support 42 is also advanced toward the face 14 to support the roof 78 above the machine 10 and face conveyor 30. To advance the roof support 42, the canopy 58 is first lowered slightly away from the roof 78. While the canopy 58 is spaced apart from the roof 78, roof spray nozzles 90 (FIG. 5) are actuated to spray water on a portion of the roof 78 above the canopy 58. The roof support 42 is advanced by operation of the ram 70 extending between the base 54 and the face conveyor 30. As shown in FIG. 4B, once the roof support 42 has reached the second or forward position, the roof spray nozzles 90 are deactivated and the canopy 58 is raised to engage the roof 78. As the roof support 42 and other, neighboring roof supports 42 advance toward the face 14, an unsupported portion of the roof 78*b* behind the roof support 42 (referred to as the gob or the goaf) is allowed to collapse. The operation of the spray nozzles 90 dampens the surface of the roof 78 and suppresses dust that might otherwise be created by the advance of the roof support 42.

Figure 5:
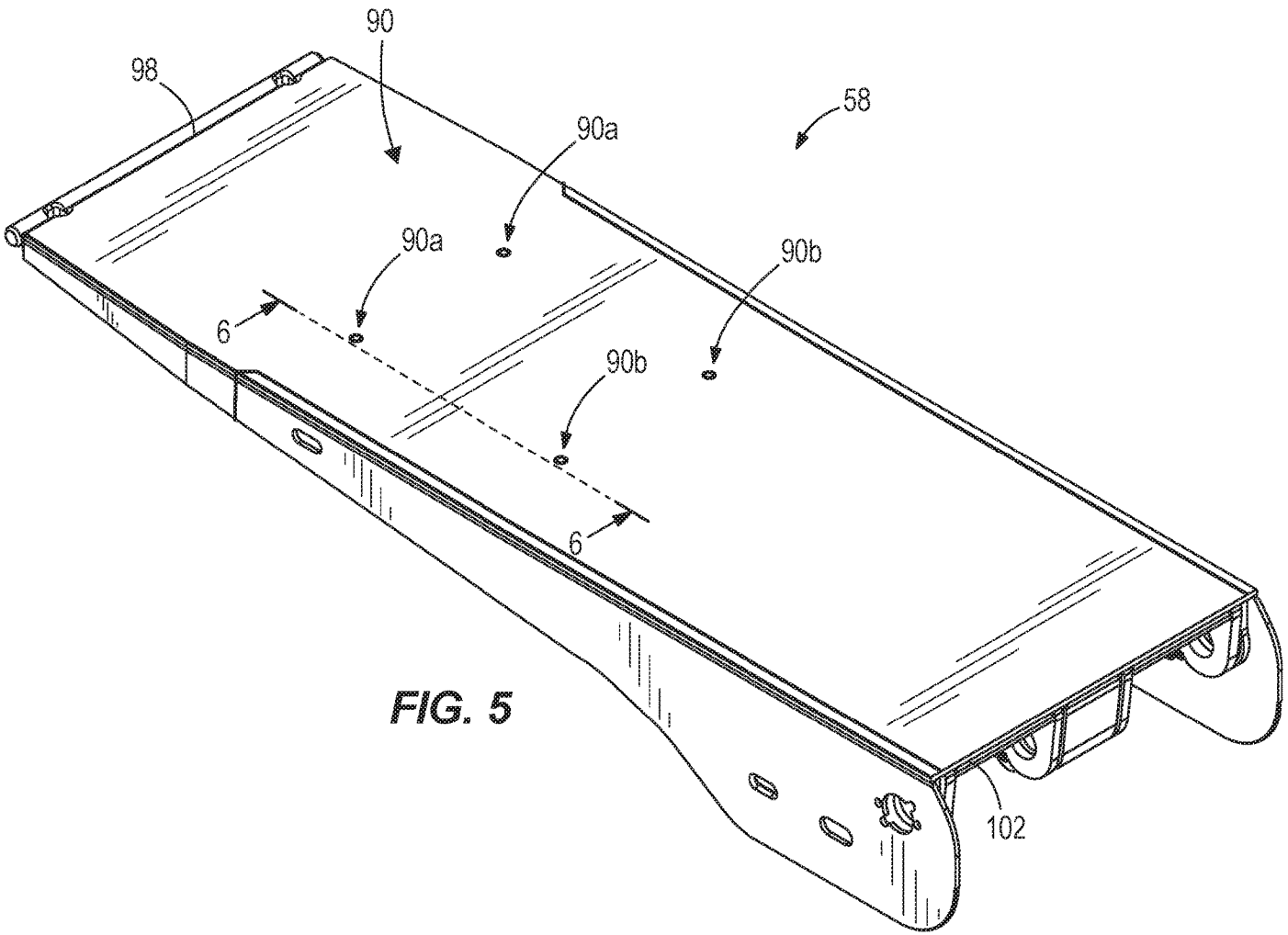
FIG. 5 is a perspective view of a canopy.

Referring now to FIG. 5, the canopy 58 includes four roof spray nozzles 90. The roof sprays or spray nozzles 90 are positioned as aligned sets, with each set including a forward spray 90*a* and a rear spray 90*b*. The forward spray 90*a* is positioned toward a forward end 98 of the canopy 58, while the rear spray 90*b* is positioned proximate a rear end 102 of the canopy 58. In other embodiments, the canopy 58 may include fewer or more spray nozzles 90, and/or may include fewer or more spray nozzles 90 positioned in each set. Additional spray nozzles 90 may be positioned between the rear spray nozzle 90*b* and the forward spray nozzle 90*a*. Also, the spray nozzles 90 may be positioned in a different manner.

Figure 6:
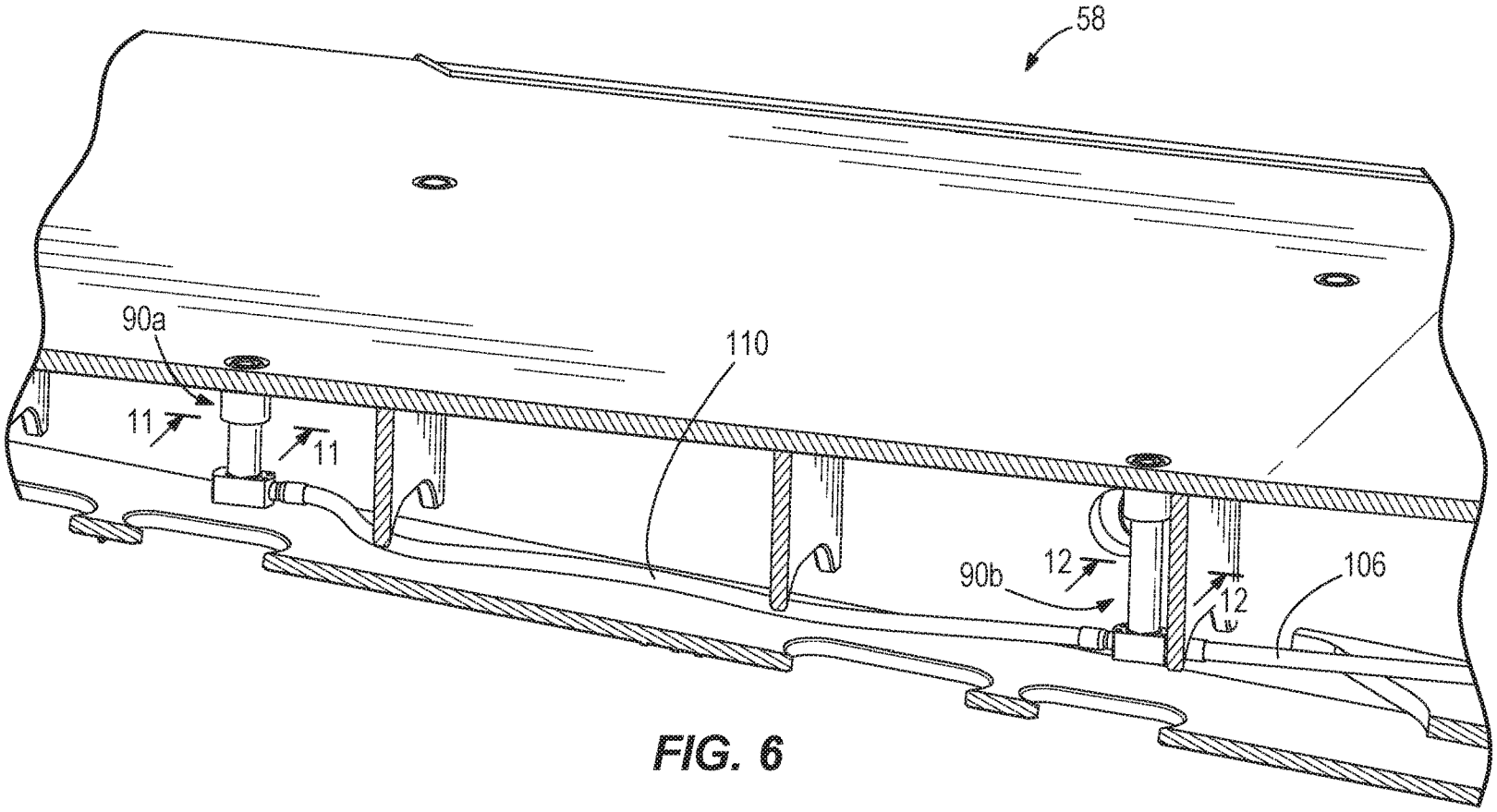
FIG. 6 is a cross-section view of a portion of the canopy of FIG. 5, viewed along section 6-6.

FIG. 6 illustrates one set of spray nozzles 90 supported in the canopy 58. In the illustrated embodiment, a first hose portion 106 provides fluid communication from a fluid source (not shown) to the rear spray nozzle 90*b*. A second hose portion 110 provides fluid communication between the rear spray nozzle 90*b* and the forward spray nozzle 90*a*, such that fluid is delivered to the spray nozzles 90 sequentially. A valve (not shown) may be actuated to control the flow of water to the spray nozzles 90. In some embodiments, actuation of the valve is controlled by a controller (not shown).

Figure 7:
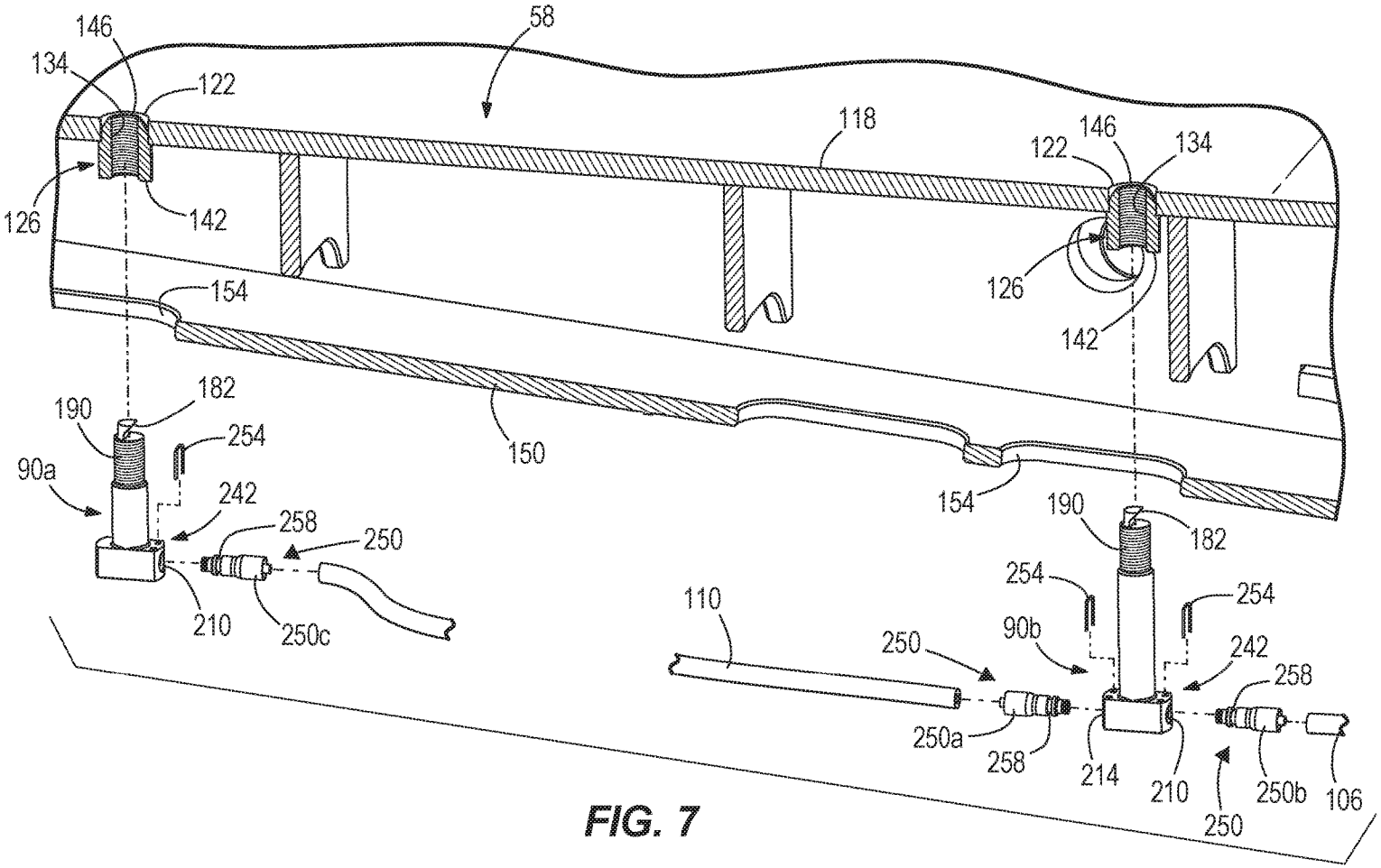
FIG. 7 is an exploded view of the portion of the canopy of FIG. 6.

Referring now to FIG. 7, an upper surface 118 of the canopy 58 includes openings 122, each of the openings 122 receives one of the spray nozzles 90. In the illustrated embodiment, an insert or lug 126 is welded within each opening 122; in other embodiments, the lug 126 may be coupled to the canopy 58 in a different manner, including being formed integrally with the canopy 58. The lug 126 includes an internal threaded bore 134 extending between a first or lower end 142 of the lug 126 and a second or upper end 146 of the lug 126. The bore 134 of the lug 126 is in communication with the associate opening 122, such that the bore 134 is open to the upper surface 118 of the canopy 58. In addition, the canopy 58 includes a lower surface 150 spaced apart from the upper surface 118 and including access holes 154. At least one of the access holes 154 is aligned with each opening 122.

Figure 8:
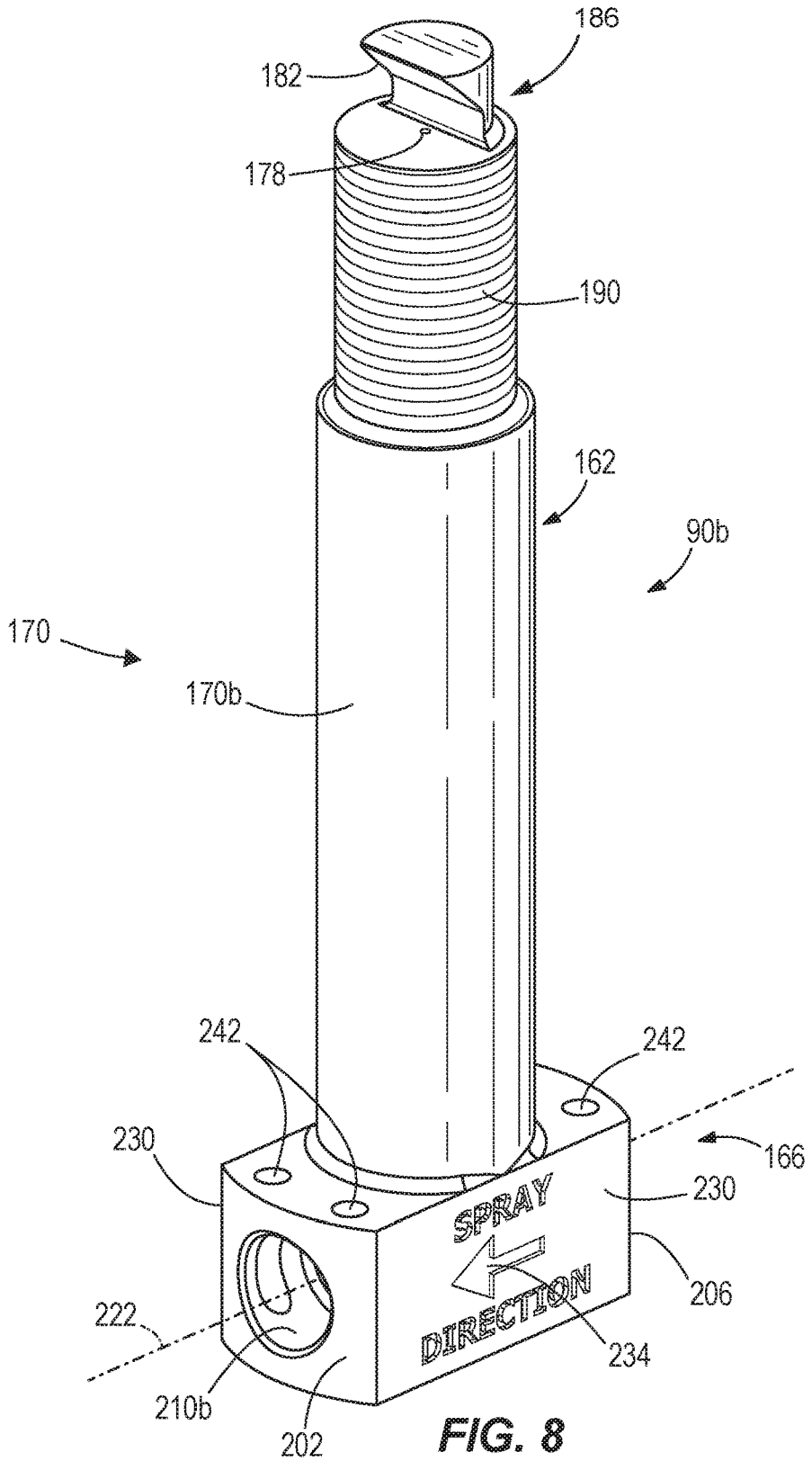
FIG. 8 is a perspective view of a rear spray nozzle.
Figure 10:
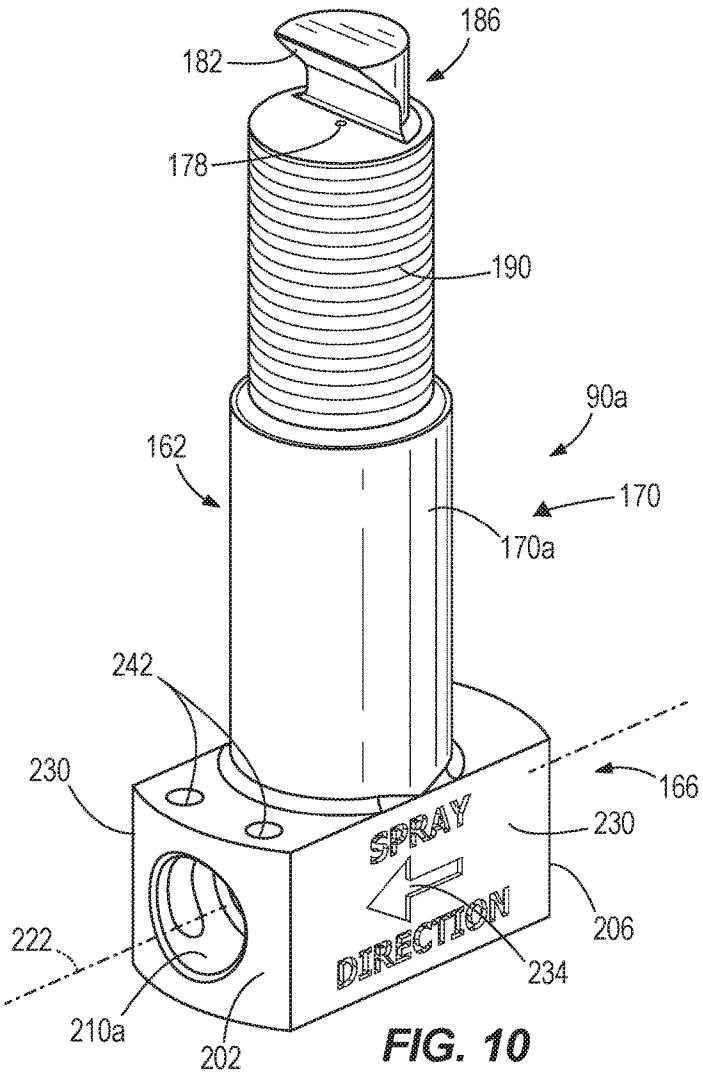
FIG. 10 is a perspective view of a forward spray nozzle.
Figure 9:
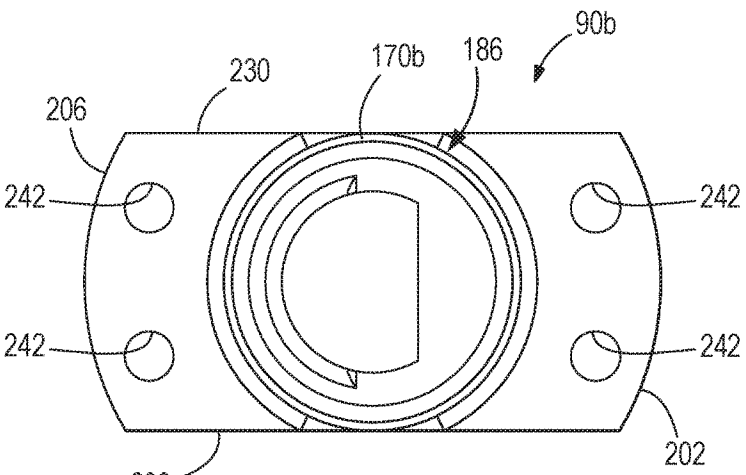
FIG. 9 is an end view of the rear spray nozzle of FIG. 8.

As shown in FIGS. 8-10, each of the spray nozzles 90 includes a body or housing, and the housing includes a first portion 162 and a second portion 166 connected to the first portion 162. In the illustrated embodiment, the first portion 162 is an elongated shaft 170, and the second portion 166 is positioned at one end of the shaft 170. The shaft 170 includes an outlet 178 and a hood 182 positioned on a distal end 186 of the shaft 170 opposite the second portion 166. In the illustrated embodiment, the hood 182 is formed as an inclined surface positioned adjacent the outlet 178. During operation, fluid emitted from the outlet 178 impacts the hood 182 and is directed away from the hood 182 in a desired direction (e.g., toward the mine roof 78 and toward the rear end 102 of the canopy 58).

In the illustrated embodiment, the shaft 170 further includes an external threaded portion 190 adjacent the distal end 186. Each of the spray nozzles 90 is inserted through one of the access holes 154 and is inserted into a lower end 142 of the associated lug 126 (FIG. 7). The external threaded portion 190 of the shaft 170 is threaded into the internal threaded bore 134 of the lug 126 such that the outlet 178 and hood 182 are positioned adjacent the opening 122 (FIG. 7) in the upper surface 118 of the canopy 58. In the illustrated embodiment, the shaft 170 of each spray nozzle 90 has a different length. For example, the shaft 170*a* of the forward spray nozzle 90*a* has a shorter length than the shaft 170*b* of the rear spray nozzle 90*b*, because the space between the lower surface 150 and the upper surface 118 (FIG. 7) proximate the forward end 98 of the canopy 58 is narrower than the space proximate the rear end 102. In other embodiments, each shaft 170 of the spray nozzles 90 has the same length. In the illustrated embodiment, the spray nozzles 90 and/or the lug 126 are each formed from stainless steel (e.g., 316 stainless steel), thereby preventing corrosion at the outlet 178 and/or on the threaded surfaces 134, 190.

The second portion 166 of each spray nozzle 90 includes a first end 202 and a second end 206. In the illustrated embodiment, the rear spray nozzle 90*b* includes a first port 210*b* (FIG. 8) positioned adjacent the first end 202, and a second port 214 (FIG. 7) positioned adjacent the second end 206. The first port 210*b* receives fluid from a source (e.g., a pump or valve) via the first hose portion 106, and the second port 214 permits fluid to pass through to downstream spray nozzles 90 (e.g., forward spray 90*a*). The forward spray nozzle 90*a* includes a port 210*a* (FIG. 10) positioned adjacent the first end 202, but does not include a port on the second end 206 since the forward spray 90*a* is positioned at a terminal end of the second hose portion 110. In some embodiments, the ports 210, 214 are female DN10 ports.

In the illustrated embodiment, an axis 222 extends between the first end 202 and the second end 206, and the axis 222 is oriented perpendicular to the shaft 170. In addition, the second portion 166 includes flat lateral surfaces 230 extending between the first end 202 and the second end 206. In some embodiments, the flat lateral surfaces 230 permit a user to grip the spray nozzle 90 (e.g., with a tool) to facilitate rotation of the spray nozzle 90 into the lug 126. Also, in some embodiments the lateral surfaces 230 include a marking 234 (e.g., an arrow) for indicating the direction in which the hood 182 is oriented, thereby assisting an operator to position the spray 90 so that the emitted fluid is sprayed in a desired direction. In the illustrated embodiment, the spray nozzles 90 are coupled to the canopy 58 to spray water toward the rear end 102 of the canopy 58.

In addition, the second portion 166 includes a pair of holes 242 positioned adjacent each port 210, 214. The holes 242 extend through the second portion 166 in a direction perpendicular to the axis 222. The holes 242 are positioned on opposite sides of the associated port 210, 214, such that each pair of holes 242 straddles the port 210, 214.

Referring again to FIG. 7, each end of the second hose portion 110 is connected to a fluid coupler 250. One fluid coupler 250*a* is received within the second port 214 of the rear spray nozzle 90*b*. When the coupler 250*a* is positioned within the second port 214, a retainer or staple 254 having parallel legs is inserted through the pair of holes 242. The legs of the retainer 254 straddle the coupler 250*a* and are positioned in a groove 258 of the coupler 250*a*, thereby securing the coupler 250*a* against movement relative to the second portion 166. In a similar manner, a fluid coupler 250*b* on the first hose portion 106 may be secured in the first port 210 of the rear spray 90*b*, and a fluid coupler 250*c* on an opposite end of the second hose portion 110 may be secured in the first port 210 of the forward spray 90*a*.

Figure 11:
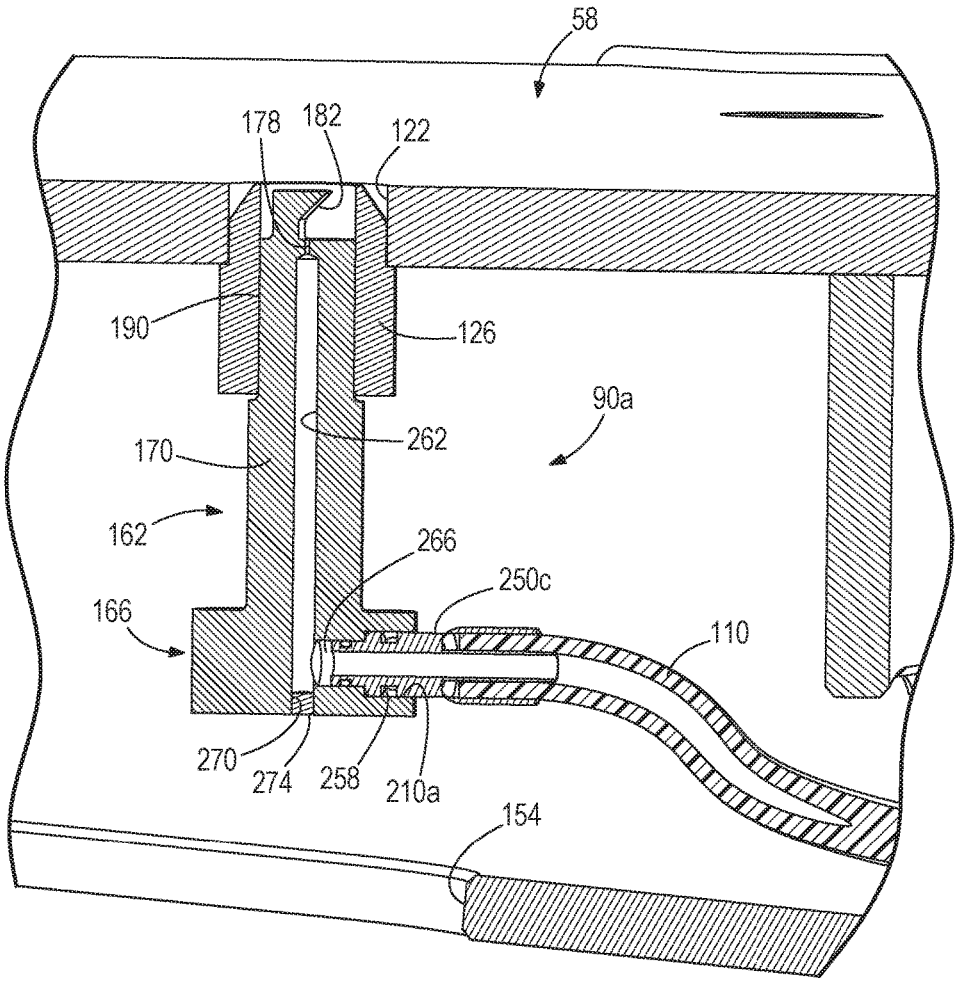
FIG. 11 is a cross-section view of the forward spray nozzle coupled to the canopy as shown in FIG. 6, viewed along section 11-11.
Figure 12:
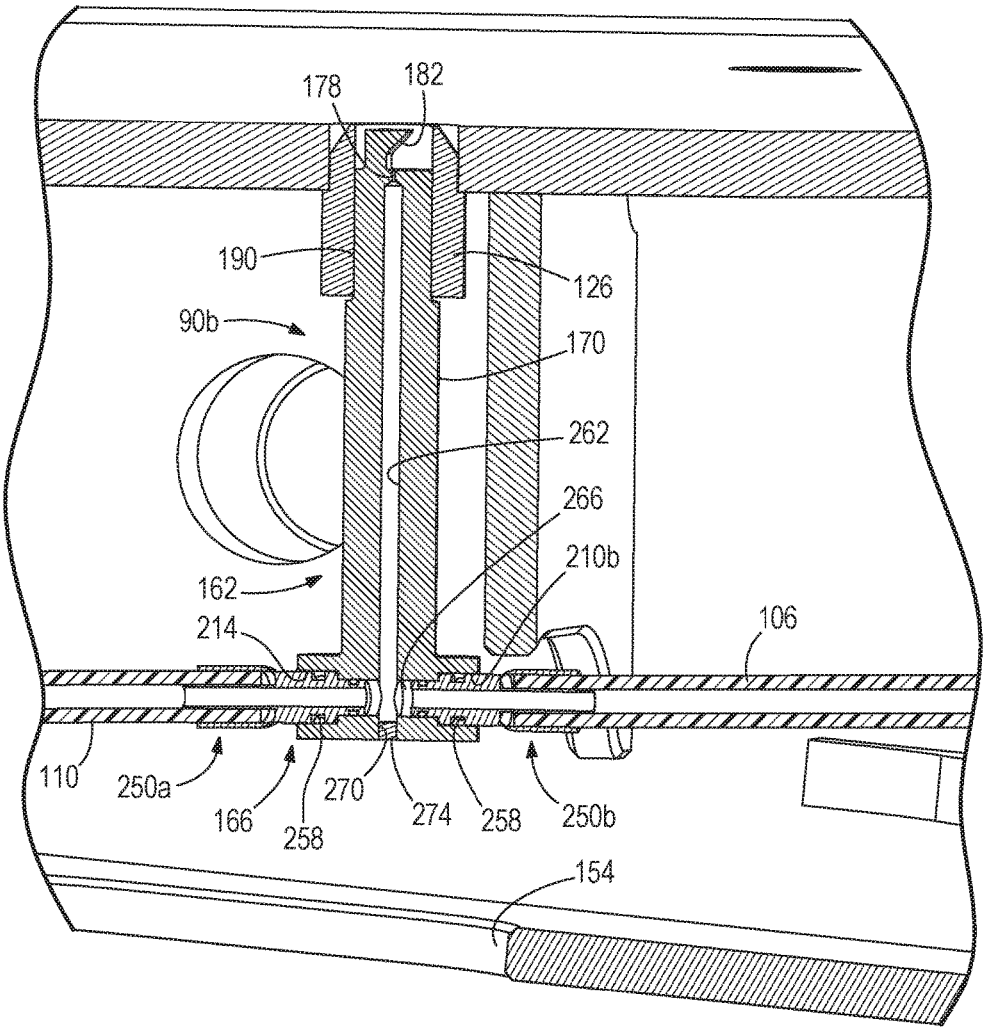
FIG. 12 is a cross-section view of the rear spray nozzle coupled to the canopy as shown in FIG. 6, viewed along section 12-12.

Referring now to FIGS. 11 and 12, each spray nozzle 90 includes a first channel 262 positioned within the shaft 170 and a second channel 266 positioned within the second portion 166. The second channel 266 is in fluid communication with the port(s) 210, 214, and the first channel 262 provides fluid communication between the second channel 266 and the outlet 178. The first channel 262 extends along a length of the shaft 170. The ports 210, 214 are integrally-formed in the roof spray nozzle 90 and oriented at 90 degrees with respect to the spray outlet 178, thereby avoiding the need for stacked fluid fittings and simplifying the fittings and connections compared to conventional spray nozzles.

Also, in the illustrated embodiment, a service port 270 is positioned in-line with the first channel 262 and is in fluid communication with both the first channel 262 and the second channel 266. The service port 270 may be a cross-drill port that is plugged during normal operation of the spray nozzle 90. In some embodiments, a plug 274 (e.g., a tapered plug) is inserted in the service port 270 during operation, and the plug 274 may be formed from stainless steel or brass. The plug 274 may be removed for maintenance purposes, providing access to the internal channels 262, 266 from a position below the canopy 58. As a result, an operator may clear a blocked channel (e.g., with a wire or small tool) or perform other maintenance on the spray nozzle 90 in situ without requiring the spray nozzles 90 or hose portions 106, 110 to be disconnected or disassembled.

To install the spray system, the shaft 170 of each roof spray nozzle 90 is threaded into a respective lug 126 in the canopy 58. Because the spray nozzles 90 are directional, the operator may fully screw the shaft 170 into the respective lug 126, and then back off or unthread the shaft 170 until the marking 234 on the second portion 166 points toward the rear end 102 of the canopy 58 (i.e., toward the gob side). The hose portions 106, 110 are connected by inserting a fluid coupler 250 into each port 210, 214 of the spray nozzles 90 and securing the fluid couplers 250 with a retainer 254. With the hose portions 106, 110 coupled to the spray nozzle 90, the spray nozzle 90 will not unscrew itself from the lug 126.

Although aspects have been described in detail with reference to certain preferred embodiments, variations and modifications exist within the scope and spirit of one or more independent aspects as described and claimed.

What is claimed is:

1. A fluid spray for an underground roof support, the spray including:

a first housing portion including an elongated shaft having a first end, a second end, and a first fluid passage extending between the first end and the second end;

a spray outlet positioned adjacent the second end of the shaft;

a second housing portion formed integrally with the first housing portion and positioned adjacent the first end of the shaft, the second housing portion including at least one port and a second fluid passage providing fluid communication between the at least one port and the first fluid passage, each port configured to be coupled to a fluid conduit, the second housing portion further including a first end, a second end, and a second housing axis extending between the first end and the second end, the second housing axis oriented perpendicular to the shaft, the second housing portion further including a pair of planar lateral surfaces extending between the first end of the second housing portion and the second end of the second housing portion; and a service port aligned with the first fluid passage, the service port being selectively opened to provide access to the first fluid passage from the first end of the first housing portion.

2. The fluid spray of claim 1, further comprising a plug removably positioned in the service port to selectively close the service port.

3. The fluid spray of claim 1, further comprising a threaded portion formed on an outer surface of the shaft and positioned proximate the second end.

4. The fluid spray of claim 1, further comprising a hood protruding from the second end of the shaft, the hood including a surface for directing fluid emitted from the spray outlet.

5. The fluid spray of claim 1, wherein the shaft defines a shaft axis extending between the first end and the second end, wherein the at least one port includes a pair of ports positioned on opposite sides of the shaft axis.

6. The fluid spray of claim 5, wherein the service port is aligned with the shaft axis.

7. The fluid spray of claim 1, wherein the first housing portion and the second housing portion are formed from stainless steel.

8. The fluid spray of claim 1, the fluid spray further comprising a pair of holes extending through the second housing portion in a direction perpendicular to the second housing axis, the holes being positioned on opposite sides of the second housing axis and configured to receive a retainer.

9. A canopy for an underground mine roof support, the canopy comprising:

a first surface configured to be biased against a mine roof, the first surface including a first end, a second end, and at least one opening positioned between the first end and the second end;

a second surface spaced apart from the first surface and facing away from the first surface;

at least one lug, each lug positioned adjacent an associated opening, each lug including a threaded bore in communication with the associated opening; and at least one fluid spray nozzle, each fluid spray nozzle including a shaft having a first end and a second end, a portion of the shaft proximate the second end threadably engaging the threaded bore of an associated one of the at least one lugs such that the second end of the shaft is positioned adjacent the associated opening, each fluid spray nozzle further including a spray outlet positioned on the second end, each fluid spray nozzle further including a housing portion integrally formed with the shaft and positioned adjacent the first end of the shaft, the shaft defining a shaft axis extending between the first end and the second end, the housing portion including a pair of planar lateral surfaces oriented parallel to the shaft axis and positioned on opposite sides of the shaft axis.

10. The canopy of claim 9, wherein the at least one fluid spray nozzle further includes a hood protruding from the second end of the shaft, the hood including a surface for directing fluid emitted from the spray outlet.

11. The canopy of claim 9, wherein the at least one fluid spray nozzle includes a forward fluid spray nozzle and a rear fluid spray nozzle, the forward fluid spray nozzle positioned proximate the first end of the first surface and the rear fluid spray nozzle positioned between the forward fluid spray nozzle and the second end of the first surface.

12. The canopy of claim 11, wherein the forward fluid spray nozzle and the rear fluid spray are both oriented to emit fluid toward the second end of the first surface.

13. The canopy of claim 9, wherein the second surface includes an access opening aligned with an associated one of the at least one lug, the access opening permitting the at least one fluid spray nozzle to pass through the second surface to be coupled to the associated lug.

14. The canopy of claim 9, wherein the housing portion includes a pair of ports positioned on opposite sides of the shaft axis, the housing portion including a second fluid passage extending between the pair of ports and oriented perpendicular to the first fluid passage.

15. The canopy of claim 9, wherein the shaft of each fluid spray nozzle includes an internal passage in fluid communication with the spray outlet, the housing portion further including at least one port receiving a fluid conduit, the at least one port in fluid communication with the internal passage and oriented perpendicular to the internal passage.

16. The canopy of claim 15, wherein the at least one fluid spray nozzle further includes a service port aligned with the internal passage, the service port being selectively opened to provide access to the internal passage while the shaft is coupled to the lug and the at least one port is coupled to the fluid conduit.

17. A roof support for an underground mine, the roof support comprising:

a base configured to be coupled to a face conveyor;

a jack coupled to the base, the jack being extendable and retractable relative to the base; and a canopy coupled to the jack, the canopy including, a first surface configured to be biased against a roof surface, the first surface including a first end, a second end, and at least one opening positioned between the first end and the second end, a second surface spaced apart from and facing away from the first surface, at least one lug, each lug positioned adjacent an associated one of the at least one openings, each lug including a threaded bore in communication with the associated opening, and at least one fluid spray nozzle, each fluid spray nozzle including a shaft having a first end and a second end, a portion of the shaft proximate the second end threadably engaging the threaded bore of an associated one of the at least one lug such that the second end of the shaft is positioned adjacent the associated opening, each fluid spray nozzle further including a spray outlet positioned on the second end, each fluid spray nozzle further including a housing portion integrally formed with the shaft and positioned adjacent the first end of the shaft, the shaft defining a shaft axis extending between the first end and the second end, the housing portion including a pair of planar lateral surfaces oriented parallel to the shaft axis and positioned on opposite sides of the shaft axis.

18. The roof support of claim 17, wherein the at least one fluid spray nozzle includes a forward fluid spray nozzle and a rear fluid spray nozzle, the forward fluid spray nozzle positioned proximate the first end of the first surface and the rear fluid spray nozzle positioned between the forward fluid spray nozzle and the second end of the first surface.

19. The roof support of claim 17, wherein the at least one fluid spray nozzle further includes a hood protruding from the second end of the shaft, the hood including a surface for directing fluid emitted from the spray outlet.

20. The roof support of claim 17, wherein the shaft of each fluid spray nozzle includes an internal passage in fluid communication with the spray outlet, the housing portion further including at least one port receiving a fluid conduit, the at least one port in fluid communication with the internal passage and oriented perpendicular to the internal passage.

21. The roof support of claim 17, wherein the at least one fluid spray nozzle further includes a service port aligned with the internal passage, the service port being selectively opened to provide access to the internal passage while the shaft is coupled to the lug and the at least one port is coupled to the fluid conduit.

* * * * *